US009656286B2

(12) United States Patent
Aigner et al.

(10) Patent No.: US 9,656,286 B2
(45) Date of Patent: May 23, 2017

(54) FLUID DISPENSER AND METHOD FOR SIMULTANEOUSLY DISPENSING FLUIDS FROM MULTIPLE CARTRIDGES

(71) Applicant: Nordson Corporation, Westlake, OH (US)

(72) Inventors: Timothy D. Aigner, Brighton, MI (US); Jeffry J. Grana, Holland, OH (US); William C. Paetow, II, Pinckney, MI (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/487,523

(22) Filed: Sep. 16, 2014

(65) Prior Publication Data

US 2015/0083751 A1 Mar. 26, 2015

Related U.S. Application Data

(60) Provisional application No. 61/880,413, filed on Sep. 20, 2013.

(51) Int. Cl.

| | |
|---|---|
| ***B05C 17/005*** | (2006.01) |
| ***B05C 17/01*** | (2006.01) |
| *B05B 15/02* | (2006.01) |

(52) U.S. Cl.

CPC .. *B05C 17/00553* (2013.01); *B05C 17/00596* (2013.01); *B05C 17/0103* (2013.01); *B05B 15/02* (2013.01)

(58) Field of Classification Search

CPC ..... B05C 17/00553; B05C 17/0103; B65D 83/38; B05B 15/02

USPC ..... 222/137, 333, 326, 325, 386, 145.6, 222/145.5

See application file for complete search history.

(56) References Cited

U.S. PATENT DOCUMENTS 1,905,733 A * 4/1933 Moore ..... F15D 1/14 137/101
3,128,710 A * 4/1964 Blomgren ..... F04C 2/084 239/570
3,884,388 A * 5/1975 Holcomb ..... B01F 5/0256 222/132

(Continued)

FOREIGN PATENT DOCUMENTS

CH 674717 A5 7/1990
EP 1260330 A2 11/2002

(Continued)

OTHER PUBLICATIONS

European Patent Office, European Search Report in EP Application No. 14185437, Feb. 25, 2015.

*Primary Examiner* — Charles P Cheyney
(74) *Attorney, Agent, or Firm* — Baker & Hostetler LLP

(57) ABSTRACT

A fluid dispenser and method for simultaneously dispensing fluids from first and second cartridges. The fluid dispenser includes a base structure and a cartridge holding assembly mounted to the base structure. The cartridge holding assembly includes first and second cartridge holders. A linear drive mechanism is mounted to the base structure and coupled with first and second drive pistons force fluids through fluid passages. A dispensing portion is provided in first and second sections for easy cleaning.

10 Claims, 5 Drawing Sheets

(56) References Cited

U.S. PATENT DOCUMENTS 4,067,479 A * 1/1978 Moline ..... B01F 7/086 222/137
4,773,562 A * 9/1988 Gueret ..... A45D 40/24 222/135
4,871,088 A * 10/1989 Cox ..... 222/47
5,589,226 A 12/1996 Geul
5,611,463 A * 3/1997 Favre ..... B05B 11/0048 222/137
5,795,390 A 8/1998 Cavallaro
5,875,928 A * 3/1999 Muller et al. ..... 222/82
6,168,335 B1 * 1/2001 Mears ..... A45D 19/02 401/118
6,308,868 B1 * 10/2001 Hoffman ..... B05C 17/00576 222/153.01
6,395,334 B1 5/2002 Prentice et al.
6,457,609 B1 * 10/2002 Keller ..... 222/137
6,488,180 B1 * 12/2002 Bayat ..... 222/137
6,540,113 B2 * 4/2003 Gardos ..... 222/137
6,540,832 B2 4/2003 Cavallaro
6,682,601 B1 1/2004 Beebe
6,868,987 B2 * 3/2005 Hedington ..... A61J 1/10 222/102
6,889,872 B2 * 5/2005 Herman et al. ..... 222/82
6,981,656 B2 1/2006 Fisher et al.
7,811,072 B2 * 10/2010 Mitchell ..... F04C 2/18 418/205
7,905,375 B2 * 3/2011 Schneider et al. ..... 222/389
8,807,394 B2 * 8/2014 Broyles et al. ..... 222/137
9,101,245 B2 * 8/2015 Rey ..... A47J 31/401
2008/0035673 A1 * 2/2008 Malik ..... B01F 5/0256 222/145.5
2013/0233880 A1 * 9/2013 Rago ..... B28B 19/0092 222/1
2014/0332561 A1 * 11/2014 Rey ..... A47J 31/46 222/145.5

FOREIGN PATENT DOCUMENTS

WO 2007044535 A2 4/2007
WO 2012113457 A1 8/2012
WO 2013109180 A2 7/2013

* cited by examiner

FLUID DISPENSER AND METHOD FOR SIMULTANEOUSLY DISPENSING FLUIDS FROM MULTIPLE CARTRIDGES

CROSS-REFERENCE TO RELATED APPLICATION

This application claims the priority of U.S. Provisional Patent Application Ser. No. 61/880,413, filed on Sep. 20, 2013, the disclosure of which is incorporated by reference herein.

TECHNICAL FIELD

The present invention generally relates to cartridge dispensing devices in which at least two cartridges simultaneously dispense one or more fluids from the cartridges.

BACKGROUND

Various industries require the dispensing of viscous fluids, such as glues, sealants, epoxies, etc. Often, these fluids are provided in the form of pre-proportioned and mixed, single use cartridges. In the case of premixed cartridges of two component sealants, for example, the cartridges of fluid may be frozen. These cartridges are thawed and inserted individually into pneumatically operated caulking guns used by technicians who then manually apply the fluid to a product or workpiece. This is a time consuming and labor intensive process. Moreover, the apparatus typically used for these applications may be difficult to use and maintain.

There is a need for fluid dispensers for simultaneously dispensing fluids from at least two cartridges, as well as related methods, enabling more efficient and productive use of the device as well as easier maintenance.

SUMMARY

In a first illustrative embodiment the invention provides a fluid dispenser for simultaneously dispensing fluids from first and second cartridges. It will be appreciated that the invention covers dispensers that are configured to simultaneously dispense from more than first and second cartridges, i.e., three or more cartridges. The fluid dispenser includes a base structure and a cartridge holding assembly mounted to the base structure. The cartridge holding assembly includes first and second cartridge holders. A linear drive mechanism is mounted to the base structure. First and second drive pistons are operatively connected to the linear drive mechanism and movable into respective first and second cartridges when the first and second cartridges are held in the first and second cartridge holders. In this manner fluids are simultaneously dispensed from the first and second cartridges.

The first and second cartridge holders further comprise tubular members carried on the cartridge holding assembly, and also removable for maintenance and/or replacement. The cartridge holding assembly further comprises a dispensing portion including respective first and second fluid passages in fluid communication with the respective first and second cartridge holders. The first and second fluid passages receive the fluids from the first and second cartridges as the first and second drive pistons are driven into the first and second cartridges. An outlet passage communicates with the first and second fluid passages. The outlet passage dispenses the fluids from the first and second fluid passages.

The dispensing portion further comprises first and second sections removably secured together, each section having lengthwise portions of the first and second passages therein for allowing cleaning of the lengthwise portions upon removal of the first section from the second section. The dispensing portion is removably secured to the first and second cartridge holders, preferably by at least one quick connector. In the illustrative embodiment, a plurality of clasps secures the dispensing portion to a remaining portion of the cartridge holding assembly.

In another illustrative embodiment a fluid dispenser comprises a base structure and a cartridge holding assembly mounted to the base structure and including first and second cartridge holders. A linear drive mechanism is mounted to the base structure. First and second drive pistons are operatively connected to the linear drive mechanism. The linear drive mechanism drives the first and second drive pistons into respective first and second cartridges when the first and second cartridges are held in the first and second cartridge holders such that fluids are dispensed from the first and second cartridges. A dispensing portion includes respective first and second fluid passages in fluid communication with the respective first and second cartridge holders for receiving fluids from the first and second cartridges as the first and second drive pistons are moved into the first and second cartridges. The dispensing portion further comprises first and second sections removably secured together. Each section includes lengthwise portions of the first and second passages therein for allowing cleaning of the lengthwise portions upon removal of the first section from the second section.

In another aspect, the invention provides a method of operating a fluid dispenser for simultaneously dispensing fluids from first and second cartridges. First and second cartridges are then loaded into respective first and second cartridge holders of the cartridge holding assembly. First and second pistons are then driven into the first and second cartridges to dispense fluids from the first and second cartridges.

The invention provides a method of dispensing fluids and cleaning residual fluid from a fluid dispenser adapted to simultaneously dispense the fluids from first and second cartridges. This method generally includes loading first and second cartridges into respective first and second cartridge holders of the cartridge holding assembly. First and second pistons are respectively driven into the first and second cartridges to force fluids from the first and second cartridges. Fluid is thereby directed from the first and second cartridges respectively into first and second fluid passages of a dispensing portion. The fluids are dispensed from the first and second fluid passages, such as, by being directed through an outlet passage that combines the fluids. After dispensing, a first section of the dispensing portion is removed from a second section of the dispensing portion to expose respective lengthwise portions of the first and second fluid passages in the first and second sections. The lengthwise portions are then cleaned of residual fluid.

These and other features of the various embodiments of this invention will become more readily apparent to those of ordinary skill upon review of the following detailed description of the illustrated embodiments taken in conjunction with the accompanying drawings

DETAILED DESCRIPTION OF THE ILLUSTRATIVE EMBODIMENTS

Figure 1:
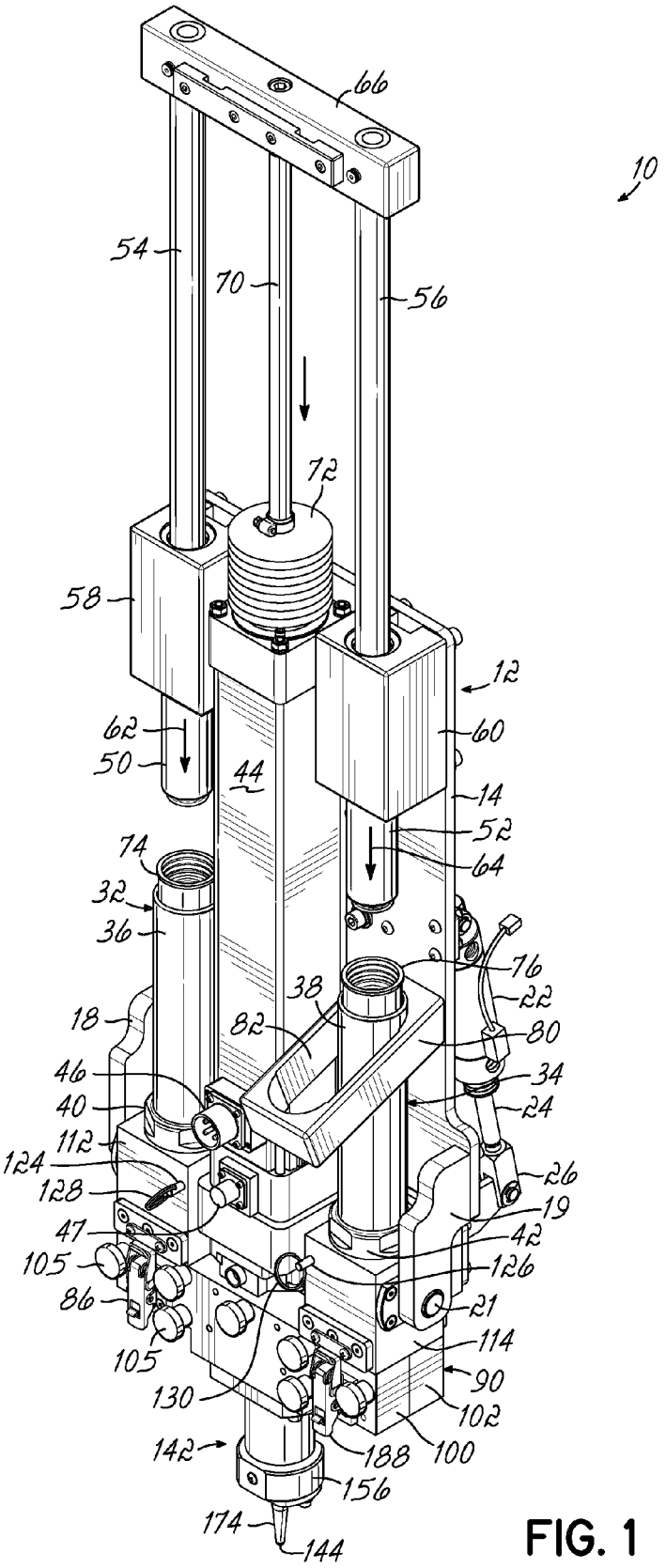
FIG. 1 is a perspective view illustrating a fluid dispenser constructed in accordance with an illustrative embodiment of the invention, and showing the cartridge holding assembly in an operating position.
Figure 2:
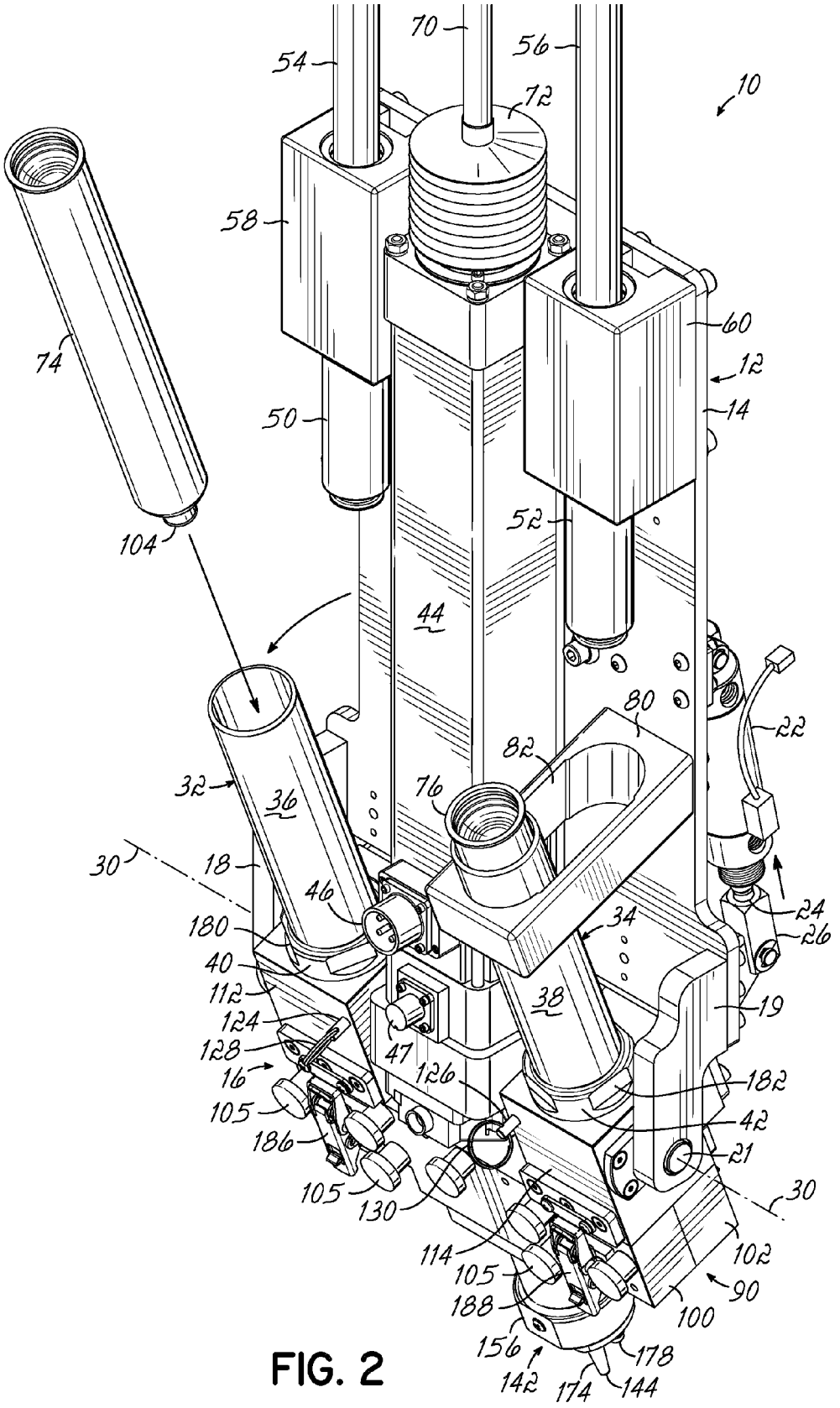
FIG. 2 is a perspective view similar to FIG. 1, but illustrating the cartridge holding assembly in a pivoted, service position.
Figure 4:
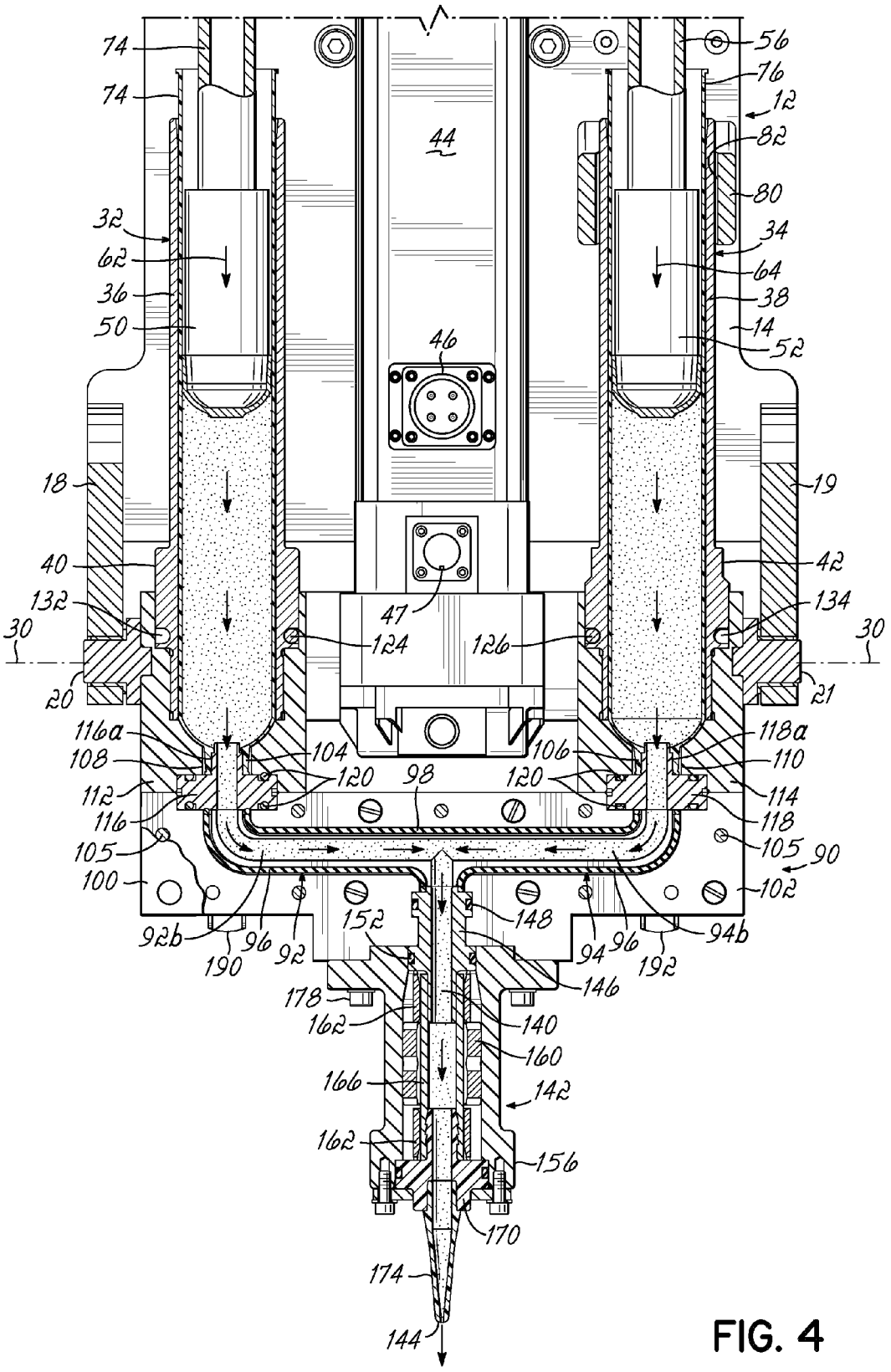
FIG. 4 is a cross sectional view similar to FIG. 3, but enlarged to better show details of the dispensing portion.

FIGS. 1 and 2 respectively illustrate a fluid dispenser 10 in operating and service positions. The fluid dispenser 10 includes a base structure 12 including a base plate 14 and a cartridge holding assembly 16 is mounted to the base structure 12. The connection between the cartridge holding assembly 16 and base structure 12 is pivotal and includes pivot mounts 18, 19 connected to the base plate 14, and two pivots 20, 21 (FIG. 4). A fluid cylinder 22, such as an air cylinder, is provided and includes an actuating rod 24 coupled to a pivoting mechanism 26. When the rod 24 is extended as shown in FIG. 1, the cartridge holding assembly 16 is held in an operating position. When the rod 24 is actuated to a retracted position as shown in FIG. 2, this pulls the pivoting mechanism 26 and pivots the cartridge holding assembly 16 about an axis 30 (FIG. 2) through the pivots 20, 21 to the service position shown in FIG. 2. The cartridge holding assembly 16 includes first and second cartridge holders 32, 34, including tubular members 36, 38 which, more specifically, comprise hollow cylindrical members having respective mounting elements 40, 42. It will be appreciated that the cartridge holding assembly 16 may be modified to hold more than two cartridges, and the invention is not limited to dispensing simultaneously from only two cartridges but, rather, encompasses dispensing from more than two cartridges. A linear drive mechanism 44 is mounted to the base structure 12. An electrical connector 46 is provided for supplying power to the electric drive motor (not shown) associated with the linear drive mechanism 44. A magnetic brake 47 is provided for stopping the linear drive mechanism 44 in the event that power is lost.

First and second drive pistons 50, 52 are operatively connected to the linear drive mechanism 44. More specifically, the pistons 50, 52 extend from rods 54, 56 that are guided by respective linear bearings 58, 60 along linear paths indicated by arrows 62, 64. A bracket 66 (FIG. 1) at an end opposite to the drive pistons 50, 52 couples the rods 54, 56 together and also couples the rods 54, 56 for movement with the linear drive mechanism 44 via a central rod 70. A bellows 72 protects the internal components of the linear drive mechanism 44 from any environmental contaminants such as dirt or dust. First and second fluid cartridges 74, 76 are inserted into the tubular members 36, 38 of the first and second cartridge holders 32, 34 as schematically illustrated in FIG. 2. The cartridges 74, 76 may contain the same fluid, for example, if greater productivity is desired than is possible with a single cartridge dispenser. Or, the cartridges 74, 76 may contain different fluids if mixing of two different fluids is desired. In any case, the fluid may comprise any desired fluid such as sealant, adhesive, epoxies or other fluids depending on the application needs. A bracket or plate 80 is rigidly coupled to the base plate 14 and includes a slot 82 through which one of the cylindrical cartridge holder tubes 38 extends. The ends of this slot 82 act as stops to ensure that the cartridge holders 32, 34 are positioned accurately in both positions, i.e., the operating position and the service position shown respectively in FIGS. 1 and 2.

Figure 3:
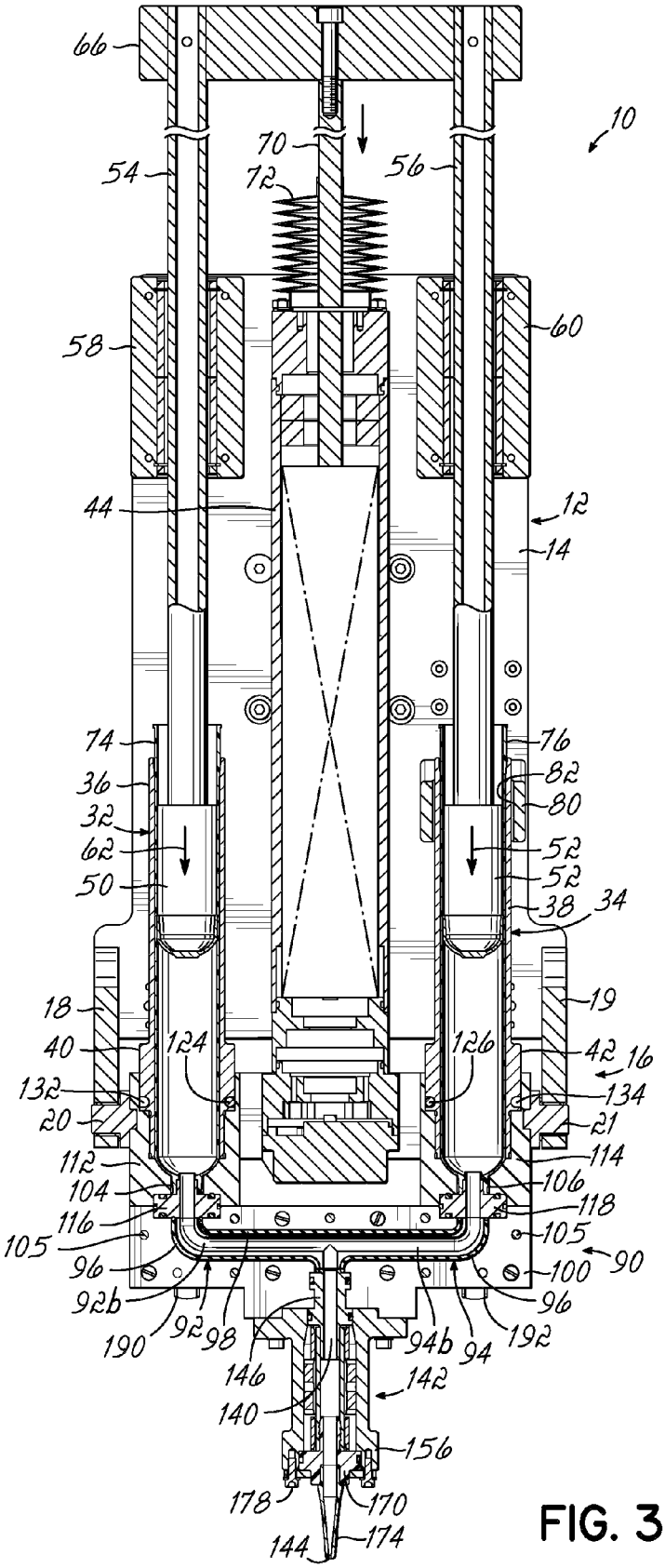
FIG. 3 is a longitudinal cross sectional view of the fluid dispenser shown in FIG. 1, with the pistons driven downward into the fluid cartridges.
Figure 5:
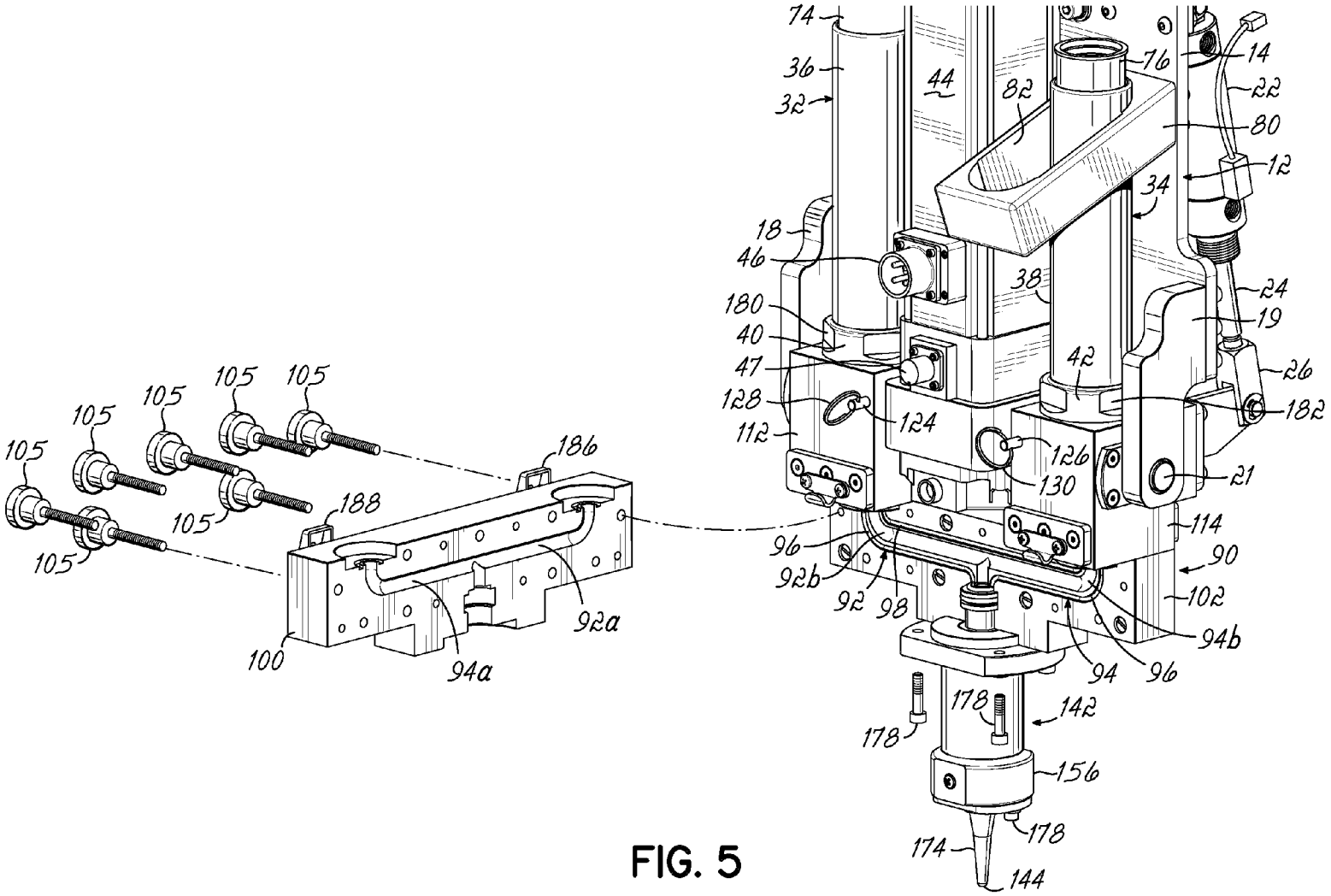
FIG. 5 is a perspective view showing the dispensing portion disassembled.

Now referring more specifically to FIGS. 3-5, the cartridge holding assembly 16 further comprises a dispensing portion 90 including respective first and second fluid passages 92, 94 in fluid communication with the respective first and second cartridge holders 32, 34. In this regard, each fluid passage 92, 94 includes a lengthwise portion 92*a*, 94*a* in one plate 100 and another lengthwise portion 92*b*, 94*b* in another plate 102 (FIG. 5). Plates 100, 102, as well as other fluid contacting components are preferably made from a material that resists adherence to the particular fluid being dispensed. One material that generally has this property is acetal. When the plates 100, 102 are fastened together using, for example, threaded fastener elements 104, a complete set of two fluid passages 92, 94 is formed and the fluid passages 92, 94 communicate with respective ends of the first and second cartridge holders 32, 34. As best shown in FIG. 4, respective seals 96, 98 are used to seal the respective lengthwise portions 92*a*, 92*b* and 94*a*, 94*b* together when the two plates 100, 102 are secured to each other. The ends of the fluid passages 92, 94 communicate with the first and second cartridges 74, 76 when the cartridges 74, 76 are in the cartridge holders 32, 34. The cartridges 74, 76 include respective fluid coupling ends 104, 106 which are received in bores 108, 110 of respective base elements 112, 114. Sealing rings 116, 118 including upper and lower O-rings 120 are provided between the plates 100, 102 of the dispensing portion 90 and base elements 112, 114 that receive the cartridge holders 32, 34. Sealing rings 116, 118 include respective tubular extensions 116*a*, 118*a* that receive the fluid coupling ends 104, 106. The cartridge holders 32, 34 are held in place to the base elements 112, 114 by pins 124, 126 which may be grasped and inserted or removed by use of rings 128, 130 (see FIGS. 1 and 2). Specifically, the pins 124, 126 are inserted into the respective base elements 112, 114 and enter annular grooves 132, 134 in the mounting elements 40, 42 of the cartridge holders 32, 34. As the fluid is driven out of the respective cartridges 74, 76 by the pistons 50, 52, the fluid travels into the first and second fluid passages 92, 94. The fluid travels from passages 92, 94 into an outlet passage 140 in a dispensing assembly 142 and flows out of an outlet 144. The dispensing assembly 142 is comprised of a connector element 146 having respective O-rings 148, 152 and coupling an outlet housing 156 to the dispensing portion 90. A series of spacers 160 and connecting elements 162 couple a fluid flow conduit 166 between the connector element 146 and an outlet connector element 170. A dispensing nozzle 174 is coupled to the outlet connecting element 170 and fastened in place by threaded fasteners 178.

When it is necessary or desirable to clean or otherwise maintain any part of the cartridge holding assembly 16, including the dispensing portion 90, the cartridge holding assembly 16 may be pivoted to the service position shown in FIG. 2. If necessary, the cartridge holders 32, 34 may be easily lifted out of the base elements 74, 76 by removing the pins 124, 126 from the annular grooves 132, 134, grasping flats 180, 182 and removing the cartridge holders 32, 34 for service, cleaning and/or replacement. The dispensing portion 90 may be easily cleaned by releasing clasps 186, 188 on each side of the dispensing portion 90 (only two of four shown in FIGS. 1, 2 and 5) and removing the dispensing portion 90 from the base elements 74, 76. In this manner, the entire dispensing portion 90 may be removed as a unit, and disassembled by removing the fasteners 105 associated with the plates 100, 102. If necessary, the fasteners 178 associated with the dispensing assembly and additional outlet components may be removed and the various parts easily cleaned of any residual fluid. Once the dispensing portion 90 is cleaned, it may be reassembled as a unit and then quickly fastened to the remaining portion of the cartridge holder assembly 16, i.e., to the base elements 74, 76 by fastening the front clasps 186, 188 and rear clasps 190, 192. It will be appreciated that the clasps may be substituted with other types of quick connectors.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. A fluid dispenser for simultaneously dispensing fluids from first and second cartridges, the fluid dispenser comprising:

a base structure;

a cartridge holding assembly pivotally mounted to said base structure and including first and second cartridge holders;

a linear drive mechanism mounted to said base structure;

first and second drive pistons operatively connected to said linear drive mechanism and movable into respective first and second cartridges when said first and second cartridges are held in said first and second cartridge holders such that fluid is dispensed from the first and second cartridges; and a dispensing portion comprising respective first and second fluid passages in fluid communication with the respective first and second cartridge holders for receiving fluid from the first and second cartridges as the first and second drive pistons are moved into the first and second cartridges, the dispensing portion further comprising a single outlet passage in fluid communication with the first fluid passage and the second fluid passage for receiving and dispensing fluid from the first and second fluid passages, said dispensing portion further comprising first and second sections removably secured together, each section having a surface that defines a lengthwise portion of said first fluid passage, said second fluid passage, and said outlet passage, within, the lengthwise portion of each section extending through the dispensing portion, wherein, when the first and second sections are removably secured together, the surface of the first section lies flush against the surface of the second section, wherein an end of the first fluid passage is in fluid communication with the first cartridge holder, wherein a first portion of the end of the first fluid passage is located within the lengthwise portion of the first section, and a second portion of the end of the first fluid passage is located within the lengthwise portion of the second section.

2. The fluid dispenser of claim 1, wherein said first and second cartridge holders further comprise tubular members removably carried on said cartridge holding assembly.

3. The fluid dispenser of claim 1, wherein said dispensing portion is removably secured to said first and second cartridge holders.

4. The fluid dispenser of claim 3, wherein said dispensing portion is removably secured to said first and second cartridge holders by at least one quick connector.

5. A method of dispensing fluids and cleaning residual fluid from a fluid dispenser adapted to simultaneously dispense the fluids from first and second cartridges, the method comprising:

loading first and second cartridges into respective first and second cartridge holders of a cartridge holding assembly;

pivoting the cartridge holding assembly relative to a base structure, wherein the cartridge holding assembly is pivotally mounted to the base structure;

driving first and second pistons respectively into the first and second cartridges using a linear drive mechanism to force fluids from the first and second cartridges respectively into first and second fluid passages of a dispensing portion and then into a single outlet passage of the dispensing portion in fluid communication with the first fluid passage and the second fluid passage;

dispensing the fluids from the single outlet passage;

removing a first section of the dispensing portion from a second section of the dispensing portion to expose respective lengthwise portions of the first fluid passage, said second fluid passage, and said outlet passage in the first and second sections, wherein each section includes a surface that defines a lengthwise portion of the first and second fluid passages within, the lengthwise portion of each section extending through the dispensing portion, wherein the surface of the first section lies flush against the surface of the second section when the first section is removably secured to the second section; and cleaning the lengthwise portions of residual fluid.

6. The method of claim 5, further comprising:

removing the dispensing portion from the first and second cartridge holders prior to cleaning the lengthwise portions of residual fluid.

7. The fluid dispenser of claim 1, wherein at least one of the first and second sections further defines at least one seal, the at least one seal extending along the lengthwise portion of the respective first and second fluid passages.

8. The method of claim 5, wherein at least one of the first and second sections defines at least one seal, the at least one seal extending along the lengthwise portion of the respective first and second fluid passages.

9. The fluid dispenser of claim 1, wherein the connection between said cartridge holding assembly and said base structure comprises a pivot mount.

10. The method of claim 5, wherein the connection between said cartridge holding assembly and said base structure comprises a pivot mount.

* * * * *